US006971554B2

(12) United States Patent
Rochat

(10) Patent No.: US 6,971,554 B2
(45) Date of Patent: Dec. 6, 2005

(54) DEVICE FOR THE CONTROLLED DISTRIBUTION OF PULVERULENT PRODUCTS

(75) Inventor: Pierre Rochat, Geneva (CH)

(73) Assignee: EXA SA, Geneva (CH)

( * ) Notice: Subject to any disclaimer, the term of this patent is extended or adjusted under 35 U.S.C. 154(b) by 240 days.

(21) Appl. No.: 10/670,858

(22) Filed: Sep. 24, 2003

(65) Prior Publication Data

US 2005/0072868 A1 Apr. 7, 2005

(51) Int. Cl.[7] ..... G01F 11/00
(52) U.S. Cl. ..... 222/370; 222/636; 141/248
(58) Field of Search ..... 222/144, 370, 222/636; 141/248, 67

(56) References Cited

U.S. PATENT DOCUMENTS 2,314,031 A * 3/1943 Colburn ..... 222/370
4,528,848 A * 7/1985 Hafner ..... 222/370
5,076,501 A * 12/1991 Tschumi ..... 222/370
5,094,403 A * 3/1992 Tschumi ..... 222/636

* cited by examiner

*Primary Examiner*—Philippe Derakshani
(74) *Attorney, Agent, or Firm*—Drinker Biddle & Reath LLP

(57) ABSTRACT

This device for the controlled distribution of pulverulent products includes a feed container (1) for said product having an outlet aperture sealed by a rotor (6) provided with a plurality of transfer cavities (7, 8), each of which comprises an inlet aperture and an evacuation aperture, the paths of said inlet apertures successively passing opposite said outlet aperture in order to be filled with said product and said evacuation apertures passing successively opposite a distribution aperture (13, 14) connected to device (12) to evacuate said pulverulent product from said transfer cavities (7, 8), for emptying therein, of sealing surfaces (5*a*, 5*b*) of said inlet and evacuation apertures, disposed along said respective paths and means (M, 15) to drive said rotor (6). Said rotor comprises device to link said cavities to said rotational axis, arranged to give said cavities a degree of freedom in a substantially perpendicular direction to said sealing surfaces (5*a*, 5*b*).

11 Claims, 5 Drawing Sheets

DEVICE FOR THE CONTROLLED DISTRIBUTION OF PULVERULENT PRODUCTS

The object of the present invention is a device for the controlled distribution of pulverulent products, including a feed container for said product having an outlet aperture sealed by a rotor provided with a plurality of transfer cavities, each of which comprises an inlet aperture and an evacuation aperture, the paths of said inlet apertures successively passing opposite said outlet aperture in order to be filled with said product and said evacuation apertures passing successively opposite a distribution aperture connected to means to evacuate said pulverulent product from said transfer cavities, for emptying therein, of the sealing surfaces of said inlet and evacuation apertures disposed along said respective paths and means to drive said rotor.

Such a device has already been proposed in WO 01/26863 to feed an abrasive particle projection system. It comprises a disk-shaped rotor provided with a series of cylindrical cavities distributed uniformly along a circle centred on the rotational axis of the disk, the axes of which are parallel to this rotational axis. This disk is sandwiched between two plates fixed together leaving just enough clearance for the disk to rotate. One of the plates has an aperture communicating with the outlet of a pulverulent product feed hopper, which is located on the path of the disk cavities. The other plate also has a distribution aperture located on the same path which is coaxial to another aperture passing through the first plate and linked to a pressurised air source, such that every time a cavity filled with powder passes between both coaxial apertures, the powder is discharged into the distribution aperture by the fluid pressure.

If the principle of this dosing device is reliable, its implementation has several disadvantages in its manufacture and operation, as well as in the concentration uniformity of the distributed powder.

It can be noted that a major problem is the problem of guiding the disk between both sealing plates which cover each of its faces. This results notably from the fact that the disk is integral with a drive shaft pivotally mounted as a result of two rollers integral with both respective plates. Given that the clearance between the disk and the sealing plates must be as small as possible in order to prevent escape of the powder which is held within the cavities by the adjacent faces of the sealing plates between which the disk rotates, yet that the disk must however be able to rotate without causing excessive heating, the difficulty of the problem to be resolved is apparent.

In this device, the inlet aperture of the first sealing plate and the distribution inlet of the second sealing plate are diametrically opposed. The reason for this arrangement was that it was thought necessary to have a sufficient distance between both apertures to ensure effective sealing to prevent the powder contained within the cavities from escaping. Given that it is however impossible to ensure total containment of the powder by this means, sooner or later the result is the formation of a film of powder between the adjacent faces of the disk-rotor and sealing plates, which brakes the disk and causes excessive heating.

It can also be mentioned that the cavities of the disk-rotor are comparatively large and spaced apart, such that the concentration of the powder as a function of time fluctuates more or less sinusoidally.

The aim of the present invention is to overcome, at least in part, the above-mentioned disadvantages.

To this end, the object of this invention is a device for the controlled distribution of pulverulent products according to Claim 1.

The main advantage of this solution is that it gives a degree of freedom to the transfer cavities in relation to the sealing surfaces, allowing optimal contact between these surfaces and the apertures of the transfer cavities without the likelihood of overheating, considerably reducing the precision stresses. Moreover, advantageously, the rotational axis of the moving parts is itself and directly the positioning reference between the moving parts and the fixed parts of the device, already ensuring precise guiding of the rotor.

As a result of this arrangement, the tolerances between these fixed and movable parts can be further reduced insofar as direct guiding eliminates the tolerances resulting from the fact that both guiding surfaces between the fixed and movable parts and between the latter and the drive means are concentric surfaces which are both arranged on the disk-rotor itself, which provides for a large degree of precision without particular difficulty. The degree of freedom provided to the transfer cavities and the reduction of these tolerances allow the likelihood of the pulverulent product escaping to be reduced and as a result the likelihood of the disk-rotor blocking and heating.

Another consequence of this greater flexibility and greater guiding precision means that it becomes possible to substantially reduce the distance between the outlet aperture of the feed hopper filling the transfer cavities of the rotor and the distribution aperture of the pulverulent product.

Therefore, it becomes possible to considerably reduce the size of the sealing surfaces of the transfer cavities between these outlet and distribution apertures, as it is sufficient to cover a small part of the surfaces of the disk-rotor alone, such that the greater part of these surfaces can be free, further reducing thereby the likelihood of the powder clogging between the disk-rotor and the sealing surfaces of the cavities of this disk-rotor.

The appended drawing shows schematically and by way of example an embodiment and an alternative of the device for the controlled distribution of pulverulent products, which is the object of the present invention.

Figure 1:
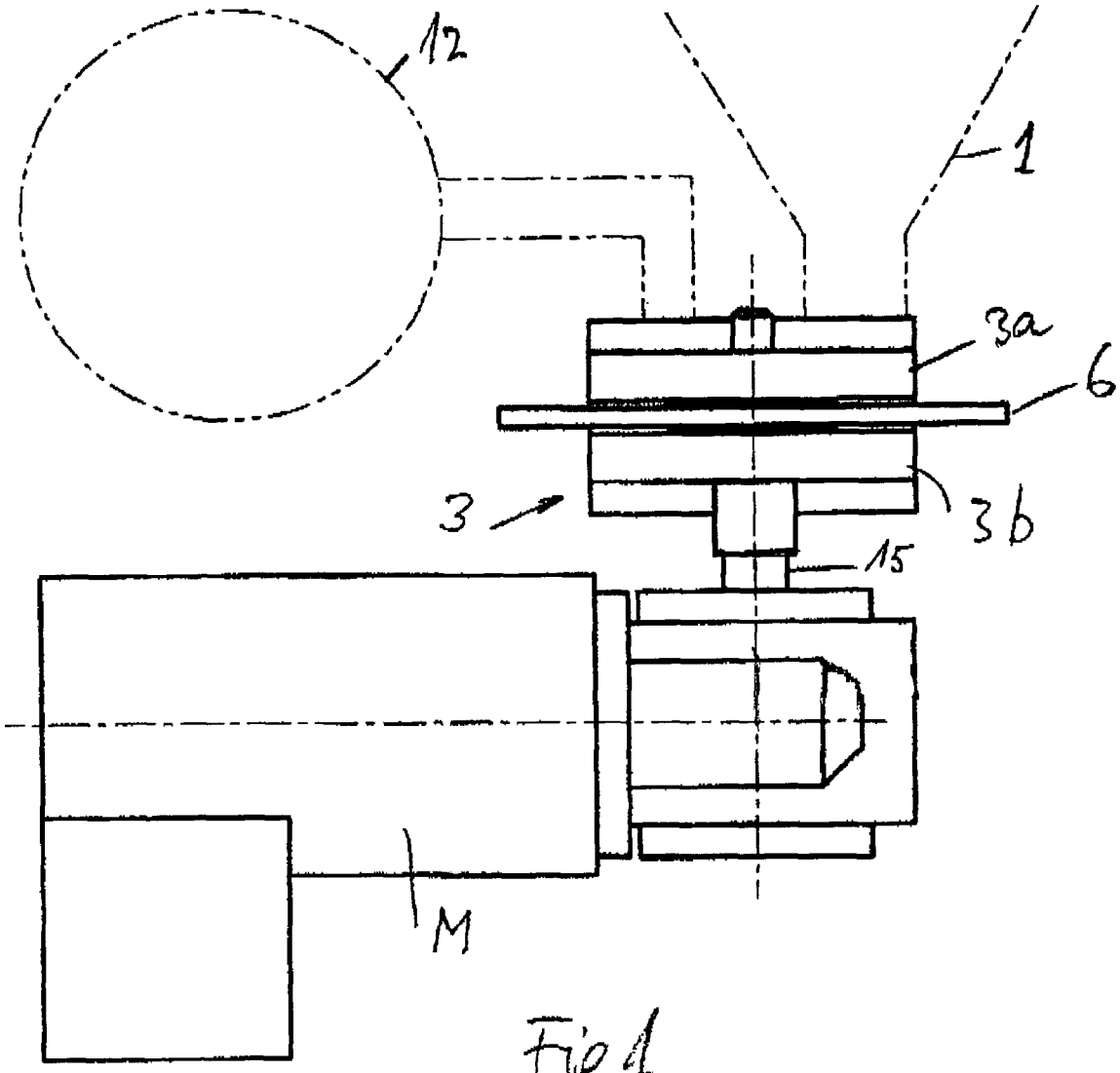
FIG. 1 is a general view of an abrasive particle projection apparatus.

Although FIG. 1 shows by way of example the device which is the object of the invention for the feeding of an abrasive particle projection apparatus, this device is in no way limited to this application but can be used instead in all applications where a pulverulent substance must be continually distributed in doses.

The pulverulent material to be distributed is contained in a feed hopper 1, the outlet of which is in communication with an inlet aperture 2 of the distribution device. This inlet aperture 2 passes through upper part 3*a* of a supporting structure 3 and is in communication with an inlet aperture 4 of an upper sealing clamp 5*a*. One surface of this upper clamp 5*a*, which is integral with upper part 3*a* of supporting structure 3, is in frictional contact with the upper surface of a dosing disk-rotor 6 and forms the active sealing surface of this sealing clamp 5*a*. Dosing disk-rotor 6 is provided with two circular and concentric series of cylindrical transfer cavities 7, 8 passing through an annular portion 6*a* of dosing disk 6, the paths of which pass through inlet apertures 2, 4. The cylindrical transfer cavities of these two circular series are half a pitch apart, such that the amount of pulverulent product distributed is substantially constant as a function of time.

Lower part 3*b* of supporting structure 3 is integral with a lower clamp 5*b*, the active surface of which, which is in frictional contact with the lower surface of annular portion 6*a* of dosing disk 6, forms a sealing surface.

The centre of dosing disk 6 comprises a tubular hub 6*b* which extends on either side of this disk 6 and which is used to receive the inner raceways of two ball bearings 9*a*, 9*b*, the outer raceways of which are integral with both upper 3*a* and lower 3*b* parts respectively of supporting structure 3. Tubular hub 6*b* of disk 6 is linked to annular part 6*a* through which cylindrical transfer cavities 7, 8 pass by means of a tapered circular part 6*c* designed to impart a degree of resilient freedom to annular part 6*a* perpendicular to the sealing surfaces of clamps 5*a*, 5*b*, enabling uniform distribution of the frictional forces of sealing surfaces 5*a*, 5*b* between both faces of annular part 6*a*.

Figure 4:
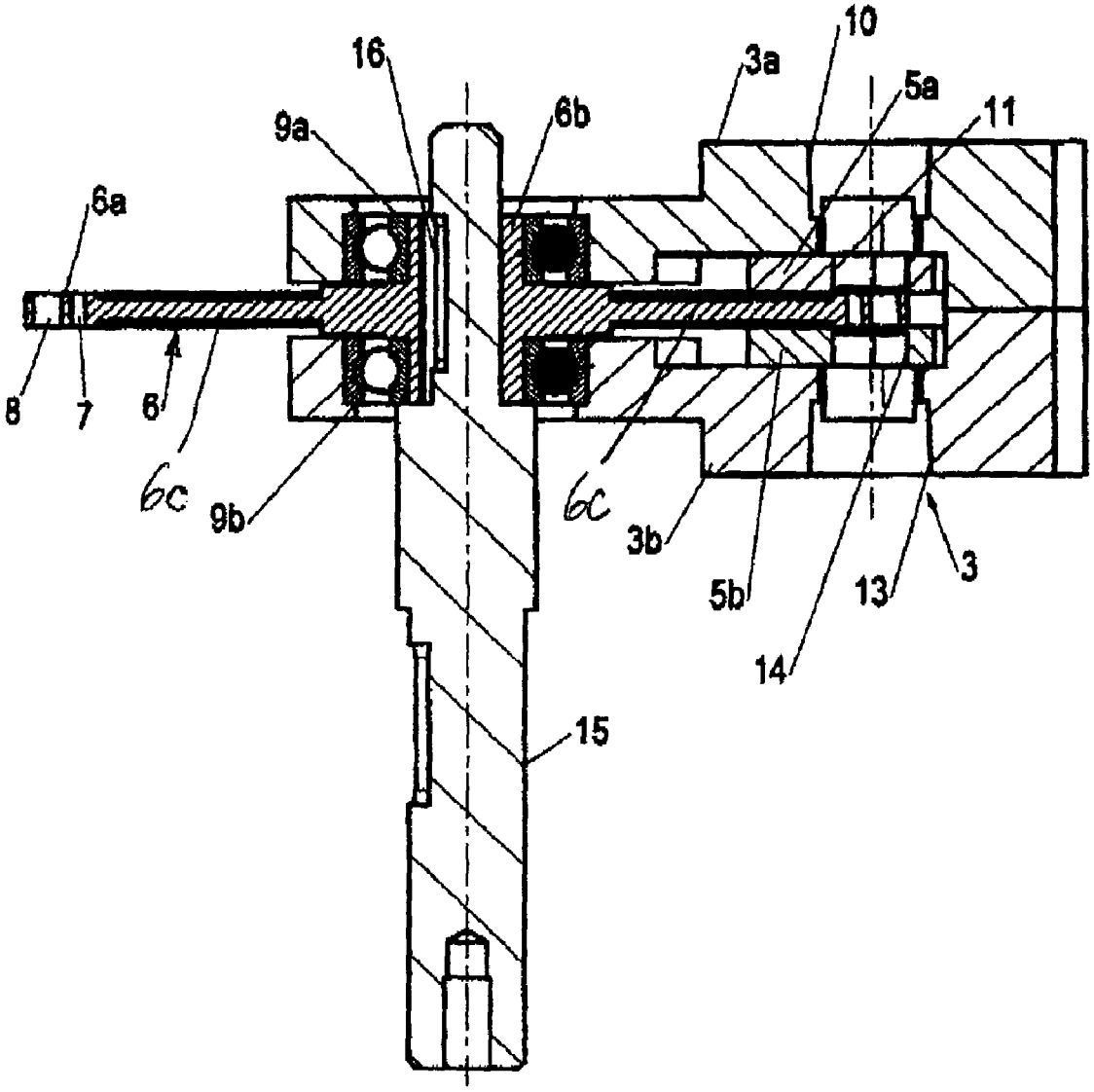
FIG. 4 is a sectional view along line IV—IV of FIG. 2.

As can be seen in FIG. 4, upper part 3*a* of supporting structure 3 comprises an aperture 10 which is in communication with an aperture 11 formed through upper sealing clamp 5*a*, located in annular portion 6*a* of dosing disk 6 inside which both circular series of cylindrical transfer cavities 7, 8 are formed. As illustrated by FIG. 1, these apertures 10 and 11 are linked to a pressurised air source 12.

Lower part 3*b* of supporting structure 3 also comprises a distribution aperture 13 which is in communication with a distribution aperture 14 formed through lower sealing clamp 5*b*. These distribution apertures 13 and 14 are aligned with apertures 10, 11 which pass through the upper part of the supporting structure and upper sealing clamp 5*a* respectively, such that these apertures 10, 11 are in communication with distribution apertures 13, 14 through both circular series of cylindrical transfer cavities 7, 8 of dosing disk 6, the paths of which pass through apertures 10, 11, 13 and 14.

Figure 2:
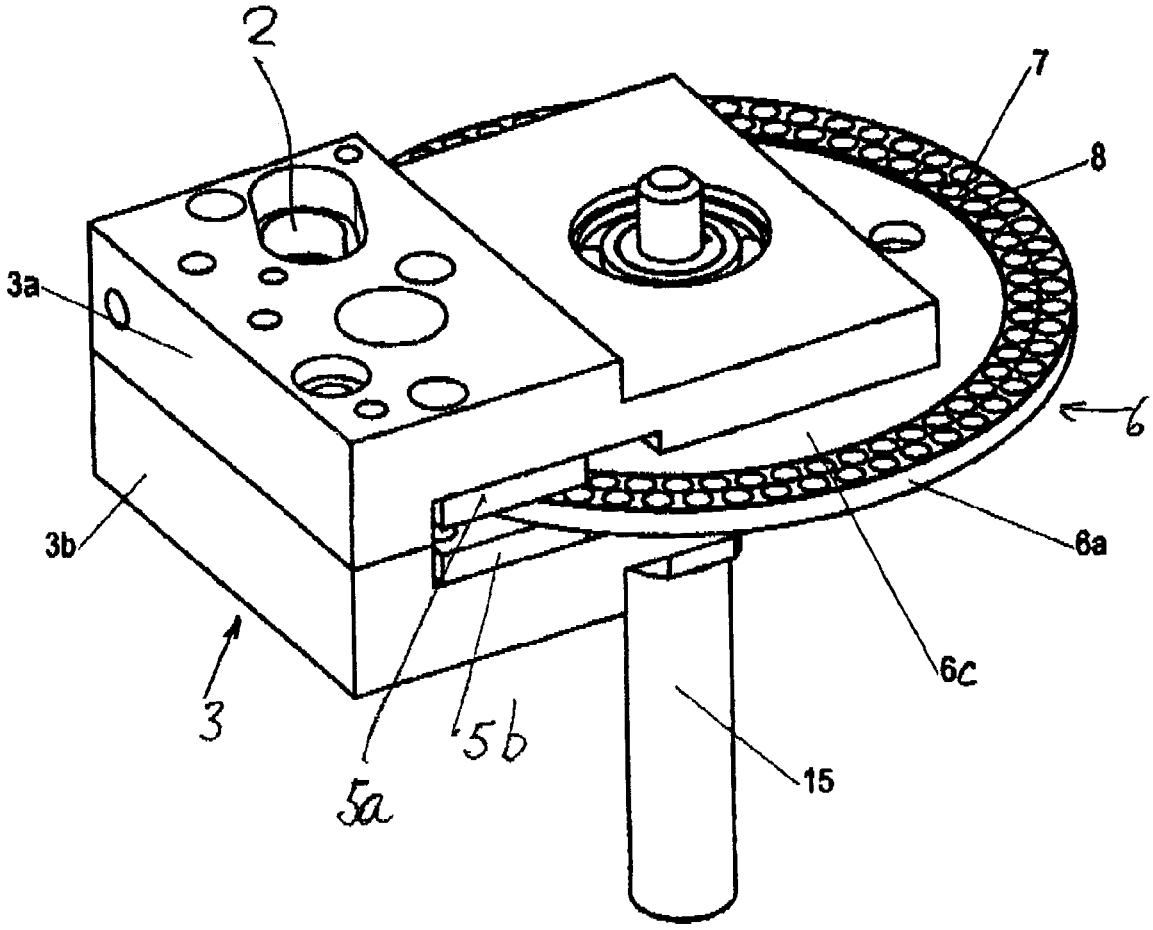
FIG. 2 is a perspective view of the device for the controlled distribution of pulverulent products, which is included in this abrasive apparatus.
Figure 3:
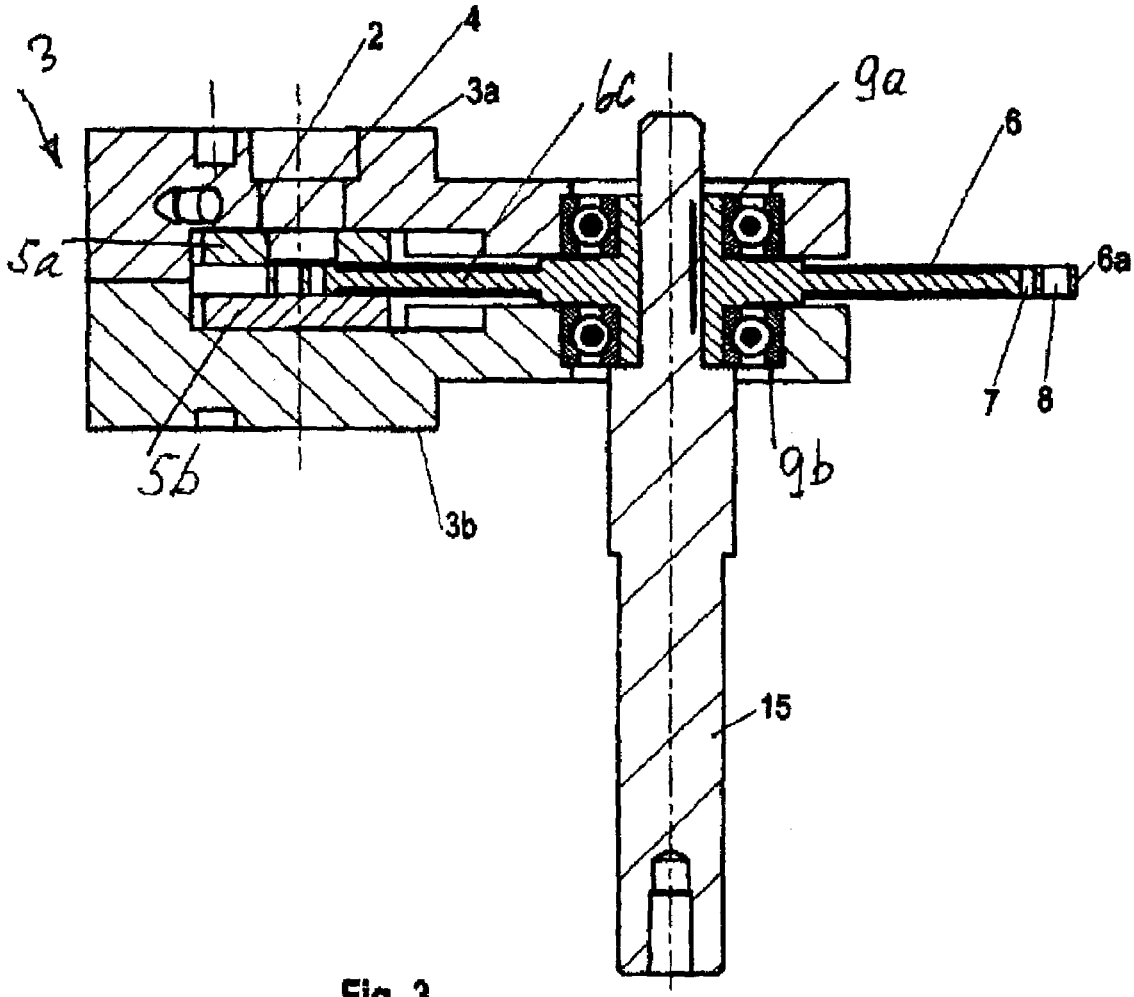
FIG. 3 is a sectional view along line III—III of FIG. 2.

As can be noted in FIG. 2, the angular distance, in relation to the centre of dosing disk 6, between inlet apertures 2, 4 and distribution apertures 13, 14 is less that 90° and is in fact, in this example, even less than 45° between the centres of both apertures 2 and 13.

Until now, it was thought necessary to have as large an angle as possible between the inlet and the distribution of the pulverulent product to ensure closure of the transfer cavities of circular series 7, 8 of dosing disk 6 when they transport the pulverulent substance from inlet 2, 4 towards distribution 13, 14. It is for this reason that the angle was 180°. It was noted that if the positioning of both sealing clamps 5*a*, 5*b* was carried out taking as a reference the axis of dosing disk 6, the resulting precision allows for a closing effect which is practically unaffected by the distance between the inlet and the distribution, due to the very large degree of guiding precision between dosing disk 6 and sealing clamps 5*a*, 5*b*. This precision allows for precise contact between disk 6 and clamps 5*a*, 5*b*. Due to the smaller frictional surface between disk 6 and clamps 5*a*, 5*b*, the device, which is the object of the invention, allows heating to be reduced. Dosing disk 6 is rotated by a shaft 15 of a drive gear motor M (FIG. 1). This shaft 15 is made rotationally integral with dosing disk 6 by key 16.

The operation of the device for the controlled distribution of pulverulent products described above consists in filling feed hopper 1 with the pulverulent product to be distributed. This hopper 1 can comprise any adequate device to prevent clogging of the pulverulent product at its outlet and guarantee even flow of this product. Such a device is not part of the present invention, such that it has not been shown, insofar as it was not useful for the understanding of the invention.

Dosing disk 6 is rotated by gear motor M and shaft 15. As both circular series of apertures 7, 8 pass under inlet apertures 2, 4 through upper part 3*a* of supporting structure 3 and upper clamp 5*a*, transfer cavities 7, 8 fill with pulverulent material through their inlet apertures adjacent to the upper surface of dosing disk 6. Lower sealing clamp 5*b* closes the distribution apertures of these cylindrical transfer cavities 7, 8 adjacent to the lower surface of dosing disk 6. As this dosing disk 6 moves towards distribution apertures 13, 14 which pass through lower sealing clamp 5*b* and lower part 3*b* of supporting structure 3, upper sealing clamp 5*a* closes the inlet apertures of cylindrical transfer cavities 7, 8, thus precisely limiting the volume of pulverulent material transferred towards the distribution apertures for each cylindrical cavity 7, 8.

When these transfer cavities 7, 8 arrive opposite distribution apertures 13 and 14 and apertures 10 and 11 linked to the pressurised fluid source 12, they put distribution apertures 13, 14 in communication with this pressurised fluid source, such that the pulverulent material which is in cylindrical transfer cavities 7, 8 is ejected through distribution apertures 13, 14.

Figure 5:
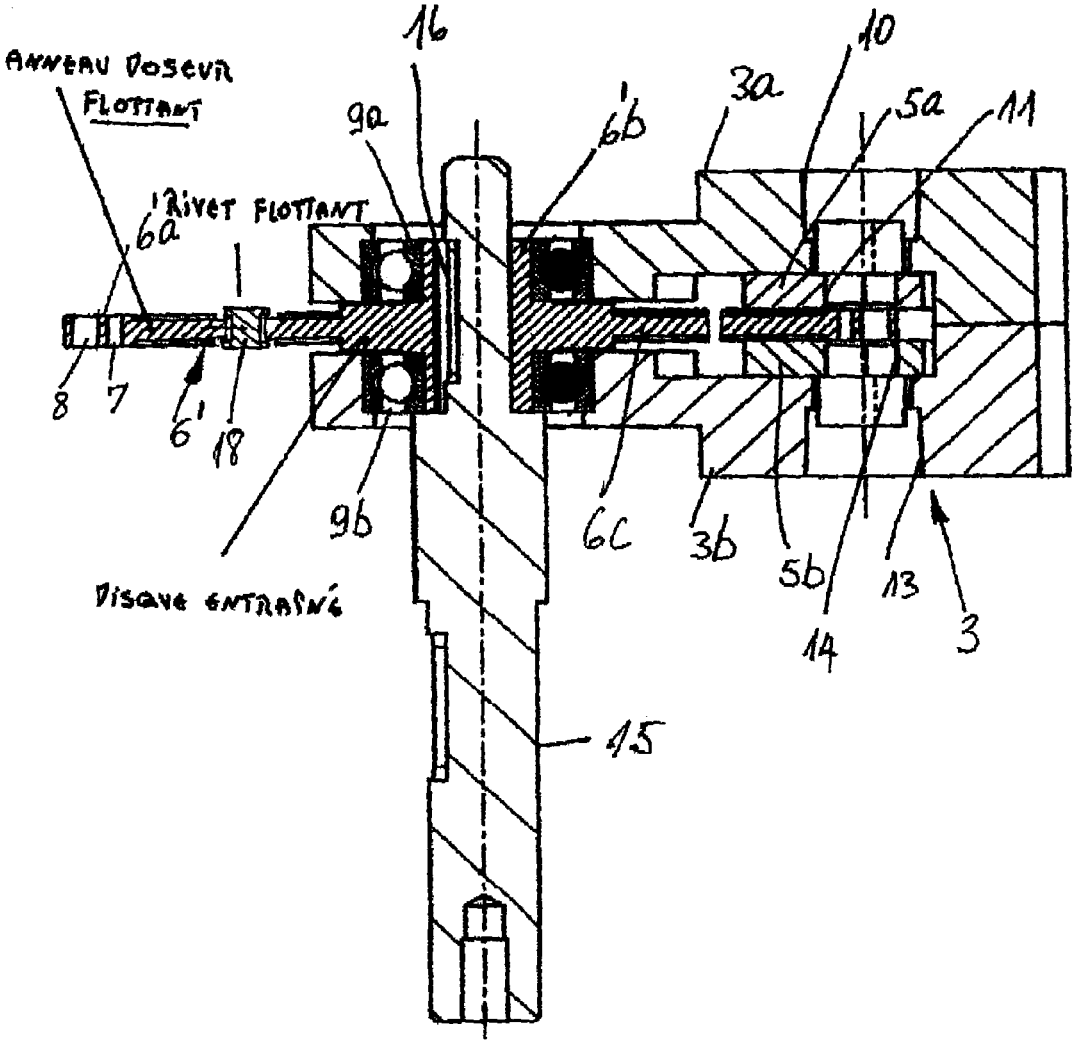
FIG. 5 is a sectional view similar to that of FIG. 4 showing an alternative.

In the alternative shown by FIG. 5, dosing disk 6' is formed with two concentric parts 6'*a*, 6'*c* linked together by a series of floating rivets 18, such that the degree of freedom of outer annular part 6'*a* which supports transfer cavities 7, 8 is further increased.

What is claimed is:

1. Device for the controlled distribution of pulverulent products including a feed container (1) for said product having an outlet aperture sealed by a rotor (6) provided with a plurality of transfer cavities (7, 8), each of which comprises an inlet aperture and an evacuation aperture, the paths of said inlet apertures successively passing opposite said outlet aperture in order to be filled with said product and said evacuation apertures passing successively opposite a distribution aperture (13, 14), connected to means (12) to evacuate said pulverulent product from said transfer cavities (7, 8), for emptying therein, of sealing surfaces (5*a*, 5*b*) of said inlet and evacuation apertures, disposed along said respective paths and means (M, 15) to rotate said rotor (6) around an axis, characterised in that said rotor comprises means for linking said cavities to said rotational axis, arranged to give said cavities a degree of freedom in a substantially perpendicular direction to said sealing surfaces (5*a*, 5*b*).

2. Device according to claim 1 wherein said rotor (6) has at least one axial guiding surface (6*a*) acting as a seat for rolling means (9*a*, 9*b*) between said rotor (6) and said sealing means (5*a*, 5*b*).

3. Device according to claim 2, wherein said rotor (6) has at least one axial guiding surface (6*a*) receiving on the one hand a rolling bearing (9*a*) disposed between said rotor (6) and said sealing surfaces (5*a*) of said inlet apertures, and on the other hand a rolling bearing (9*b*) disposed between said rotor (6) and said sealing surfaces (5*b*) of said evacuation apertures.

4. Device according to claim 1, including a detachable key linkage (16) between said rotor (6) and said drive means (M, 15).

5. Device according to claim 1, wherein the angle between said outlet aperture of said feed container (1) and said distribution aperture (13, 14) is less than 90°.

6. Device according to claim 1, wherein said rotor (6) is disk-shaped and said sealing surfaces (5*a*, 5*b*) substantially extend on the angular portion of this disk located between said outlet apertures of said feed container (1) and said distribution apertures (13, 14), leaving clear the parts of this disk which are located outside said angular portion.

7. Device according to claim 1, including two concentric circular series of transfer cavities (7, 8), the cavities of one series being half a pitch apart from the cavities of the other series.

8. Device according to claim 1, wherein said cavities have a cylindrical shape, the straight sections of which are substantially smaller than those of the outlet aperture of said feed container (1) and said distribution aperture (13, 14).

9. Device according to claim 1, wherein said transfer cavities (7, 8) are cylindrical, the length of these cavities not exceeding twice the diameter of their sections.

10. Device according to claim 6, wherein said transfer cavities (7, 8) are formed in an annular portion (6*a*) of said disk (6) with a thickness which is greater than that which links this annular portion to the central part of this disk and which has a resilience capable of giving said annular portion (6*a*) a degree of freedom in said substantially perpendicular direction to said sealing surfaces (5*a*, 5*b*).

11. Device according to claim 6, wherein said transfer cavities (7, 8) are formed on an annular part 6'*a* linked to the central part of said rotor by floating linkage means.

* * * * *